United States Patent [19]

Clanan

[11] 4,120,532

[45] Oct. 17, 1978

[54] SNAP-ON SWING-AWAY FOOT REST FOR WHEEL CHAIRS

[76] Inventor: Wayne N. Clanan, 1458 Burns Ave., Detroit, Mich. 48214

[21] Appl. No.: 820,695

[22] Filed: Aug. 1, 1977

[51] Int. Cl.[2] ..... A47C 7/50

[52] U.S. Cl. ..... 297/429; 297/423

[58] Field of Search ..... 297/423, 429, 438

[56] References Cited

U.S. PATENT DOCUMENTS

| | | | |
|---|---|---|---|
| 3,205,006 | 9/1965 | Mommsen | 297/423 |
| 3,854,774 | 12/1974 | Limpach | 297/429 |

*Primary Examiner*—James C. Mitchell

*Attorney, Agent, or Firm*—Willis Bugbee

[57] ABSTRACT

Attachable to and instantly detachable from a front leg of a wheel chair is a bracket component including an inclined tubular arm and an approximately semi-cylindrical upright attachment member including a lower hook portion with its open side facing away from the inclined arm and an approximately semi-cylindrical upper hook portion spaced vertically away from the lower hook portion with its open side facing toward the inclined arm and connected to the upper end of an extension thereof with a gap between said hook portions. A foot rest component has a stem telescopingly engaging and attached to the lower part of the inclined arm. To attach the device to a wheel chair leg, the operator swings the device 90 degrees so that the semi-cylindrical hook portions are horizontal, whereupon he pushes the gap between them around the wheel chair leg until the leg abuts the connecting portion between the semi-cylindrical hook portions, whereupon he swings the device back to its normal vertical position. As a result, the oppositely-facing semi-cylindrical hook portions now snugly engage opposite sides of the wheel chair leg. To prepare the wheel chair leg for the attachment of the bracket, it is only necessary for the operator to drill a pair of aligned diametral holes through the wheel chair leg and insert a stop pin, the outwardly-projecting opposite ends of which engage notches in the lower end of the lower hook portion of the attachment member. By lifting each foot rest so that its notches move away from the pin, each foot rest can then be swung horizontally inward out of the way against the adjacent side of the wheel chair or beneath it.

1 Claim, 5 Drawing Figures

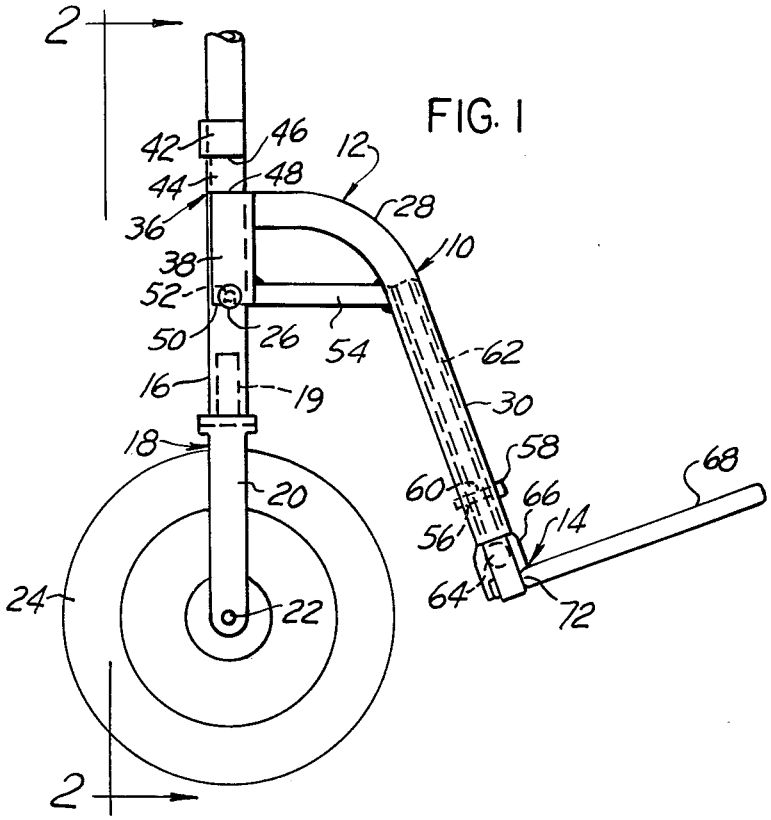
FIG. 1
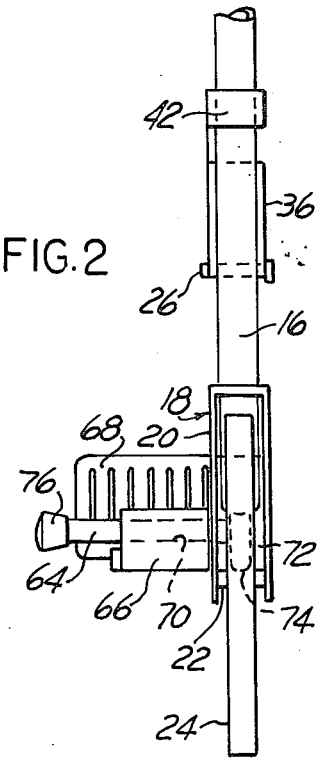
FIG. 2
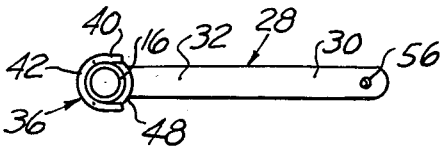
FIG. 5
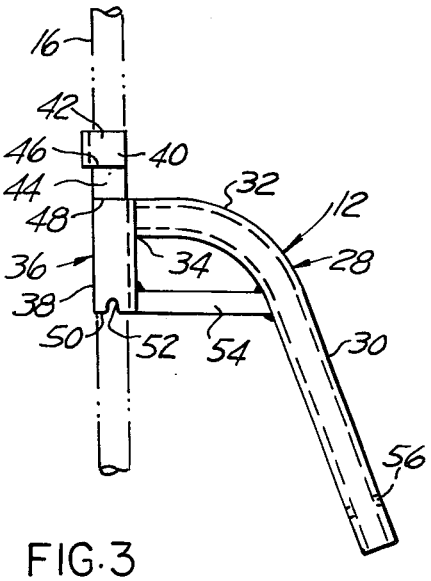
FIG. 3
FIG. 4
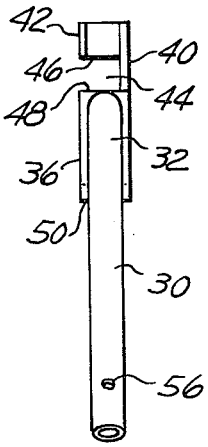

SNAP-ON SWING-AWAY FOOT REST FOR WHEEL CHAIRS

BACKGROUND OF THE INVENTION

The attachment of one type of foot rest previously used requires the welding of three crescent-shaped lugs to the wheel chair leg, these lugs having upstanding pins engaged by correspondingly-located holes in three arms fitting onto the pins. These pins prevent the operator from swinging the device inward against or beneath the wheel chair, so that it can only swing outward. It is difficult or impossible for a blind person to attach it because it has to be viewed visually in order to simultaneously align the holes in the arms with the lins on the lugs. Furthermore, this prior device is more costly to manufacture because of the several weldments which it requires.

SUMMARY OF THE INVENTION

The invention particularly resides in the unitary construction of the bracket component with its oppositely-facing spaced upper and lower hook portions of approximately semi-cylindrical or U-shaped cross-section with the gap between them for passing by the wheel chair leg during attachment or removal; also in the pin and notch arrangement for selectively locking the foot rest in an immovable position and for releasing it to swing inward out of the way against or beneath the wheel chair.

IN THE DRAWING,

FIG. 1 is a side elevation of the foot rest of the present invention as attached to a wheel chair leg;

FIG. 2 is a left-hand or rear elevation of the foot rest and wheel chair leg of FIG. 1, looking in the direction of the arrows 2--2 therein;

FIG. 3 is a diagrammatic view similar to FIG. 1 but with the showing in dotted lines of the wheel-chair leg but with the foot rest removed from the foot rest bracket component;

FIG. 4 is a right-hand or front elevation of the wheel chair foot rest bracket component shown in FIG. 3 but completely detached from the wheel chair leg; and FIG. 5 is a top plan view of the wheel chair foot rest bracket component shown in FIGS. 3 and 4 but attached to the wheel chair leg.

Referring to the drawing in detail, FIGS. 1 and 2 show a snap-on swing-away wheel chair foot rest, generally designated 10, as consisting generally of the wheel chair foot rest bracket component 12 at the lower end of which is mounted a foot rest component 14. The upper end of the bracket component 12 is adapted to be instantly attached to or detached from either front leg 16 of a conventional wheel chair (not shown). The wheel chair leg 16 is ordinarily tubular and at its lower end is provided with a swivel wheel or caster 18 with a stem 19 and a rotatable fork 20 carrying the axle 22 of the roller or wheel 24. For the purposes of the present invention, the leg 16 is drilled diametrically at the desired level to receive a stop pin 26 with laterally-projecting opposite ends for supporting and releasably locking the foot rest 10 in the manner described below.

The foot rest bracket component 12 (FIGS. 3, 4 and 5) consists of a tubular arm 28 having an inclined straight lower portion 30 and an arcuate upper portion 32, the latter of which is welded or otherwise suitably secured at its upper or inner end 34 to a vertical attachment member 36 having an elongated lower hook portion 38 of approximately semi-cylindrical or U-shaped cross-section facing leftward away from the arm 28 (FIG. 3) and having an extension or bridge portion 40 (FIG. 4) extending upward from the upper end 48 of the arm end 34 to an approximately semi-cylindrical or U-shaped upper hook portion 42 facing in the opposite direction to the lower hook portion 38, namely rightward toward the arm 28. Thus, a gap or recess 44 occurs between the lower edge 46 of the upper hook portion 42 and the upper edge 48 of the lower hook portion 38 through which the wheel chair front leg 16 can pass, as explained below in connection with the description of the operation of the invention. The lower end 50 of the attachment member 36 is provided with diametrically opposite notches 52 which are engaged by the projecting outer ends of the pin 26 (FIG. 1). In order to increase the rigidity of the bracket component 12, a horizontal strut 54 is welded or otherwise connected between the tubular arm 28 and the lower end 50 of the attachment portion 36.

The straight lower portion 30 of the tubular arm 28 is provided with diametrically-aligned holes 56 (FIGS. 3 and 4) adapted to receive a headed bolt or pin 58, the shank of which likewise passes through correspondingly-aligned holes 60 in a tubular stem 62 of the foot rest component 14. The stem 62 is telescopingly received within the inclined straight lower portion 30 of the tubular arm 28 (FIG. 1). Secured to and projecting laterally from the tubular stem 62 near the lower end thereof is a horizontal foot rest pivot shaft 64 (FIG. 2). Swingably mounted on the foot rest shaft 64 is a bearing boss 66 integral with the inner end of a foot rest plate 68 and containing a horizontal bearing bore receiving the pivot shaft 64. Projecting laterally outward from the inner end of the foot rest plate 68 is a stop portion 72 engaging the lower end portion 74 of the stem 62 below the horizontal pivot shaft 64 when the foot rest plate 70 has been swung into perpendicular relationship with the stem 62 (FIG. 1). A knob 76 is mounted upon the outer end of the foot rest pivot shaft 64.

Prior to the installation of the invention, each front leg 16 of the wheel chair is drilled diametrically and laterally at a convenient height from the floor, according to the particular occupant, whereupon the stop pin 26 is inserted snugly therein with its opposite ends projecting slightly outward from the leg 16. The bracket component 12 is then snapped into its particular leg 16 above the stop pin 26 thereof by first swinging it upward in its own plane until the U-shaped or semi-cylindrical hook portions 36 and 42 are horizontal, whereupon the operator pushes the extension or bridge portion 40 therebetween toward the leg 16 until the leg 16 enters the gap or recess 44. When the extension or bridge portion 40 has come into abutting engagement with the leg 16, the operator swings the bracket component 12 downward so that the semi-cylindrical or U-shaped hook portions 38 and 42 swing into abutting engagement with the opposite sides of the leg 16. The operator then lowers the bracket component 12 until the diametrically opposite notches 52 in the lower end 50 of the vertical attachment member 36 engage the projecting outer ends of the stop pin 26. Having mounted the bracket component 12 on each front leg 16 in the above-described manner, the operator inserts the stem 62 of each foot rest component 14 in the inclined straight lower portion 30 of its allotted bracket component 12. Then, with the user of the wheel chair seated therein, the operator adjusts the stem 62 upward or downward until the foot rest plate 70 is at the most comfortable height for supporting the user's foot. The operator now swings the foot rest component 14 laterally until the holes 56 and 60 in the bracket arm 30 and stem 62 come into alignment with one another, whereupon he inserts the headed bolt or pin 58 therethrough, thereby locking the foot rest component 14 and with it the entire swing-away foot rest 10 in its forwardly-facing position (FIGS. 1 and 2). The operator then repeats the foregoing operation for the other forward wheel chair leg 16, after which the wheel chair is ready for use.

To swing the foot rests 10 inward against or beneath the sides of the wheel chair, for preventing them from obstructing a doorway or from occupying too much space in storage, the user lifts each bracket component 12 so as to raise the notches 52 therein above the opposite ends of the pin 26. The user then swings the entire foot rest 10 in either direction to place it in the desired position of non-use. To swing either foot rest 10 back into its position of use, or to remove either foot rest 10 from the wheel chair leg 16, the operator reverses the above-described procedures.

It will be understood that instead of the upper hook portion being rigidly connected to the bridge portion 40 and thereby rigidly connected to the lower hook portion 36, the upper hook portion 42 may be pivotally connected to the bridge portion 40 on a vertical pivot axis so as to swing horizontally sidewise relatively thereto. The upper hook portion 42 would then preferably be releasable, latched to the bridge portion 40 to hold it in alignment with the lower hook portion 36.

I claim:

1. A snap-on swing-away bracket for connecting a conventional wheel chair foot rest to a leg of a conventional wheel chair, said bracket comprising an elongated hollow vertical wheel chair leg-attachment member having longitudinally-spaced lower and upper wheel chair leg-gripping portions of approximately U-shaped cross-section having oppositely-facing entrance openings of sufficient widths for the passage therethrough of said leg and having interior configurationa adapted to snugly engage said leg, said leg-gripping portions having a gap therebetween also of sufficient width for the passage therethrough of said leg, and an elongated downwardly-extending foot rest mounting arm having an upper arm portion secured to said leg-attachment member and having a lower arm portion with means therein for connecting the conventional foot rest thereto, said lower leg-gripping portions having a lower end with an upwardly-extending notch therein adapted to fixedly engage a stop element projecting laterally from the wheel chair leg, said lower end aside from said notch having a mainly annular transverse bearing face slidably engageable with the stop element in response to swinging of said bracket relatively to the wheel chair leg while supported by the stop element.

* * * * *